US005094036A

United States Patent [19]

Botteghi

[11] Patent Number: 5,094,036

[45] Date of Patent: Mar. 10, 1992

[54] WIDE-BELT SANDER MACHINE

[75] Inventor: Gino Botteghi, Rimini, Italy

[73] Assignee: DMC S.P.A., Bologna, Italy

[21] Appl. No.: 593,112

[22] Filed: Oct. 5, 1990

[30] Foreign Application Priority Data

Oct. 31, 1989 [IT] Italy ..... 3679 A/89

[51] Int. Cl.[5] ..... B24B 21/12

[52] U.S. Cl. ..... 51/141; 51/148; 51/138; 51/147

[58] Field of Search ..... 51/141, 62, 135 R, 148, 51/137, 138, 170 EB, 140, 147, 165.9

[56] References Cited

U.S. PATENT DOCUMENTS 3,524,284 8/1970 Means ..... 51/135 R
4,651,474 3/1987 David ..... 51/138

FOREIGN PATENT DOCUMENTS 0225296 6/1987 European Pat. Off. .
1477943 7/1969 Fed. Rep. of Germany .
3111480 10/1982 Fed. Rep. of Germany .
3339956 7/1984 Fed. Rep. of Germany .
447861 3/1968 Switzerland .
926297 5/1963 United Kingdom .

*Primary Examiner*—Bruce M. Kisliuk
*Assistant Examiner*—Eileen Morgan
*Attorney, Agent, or Firm*—Darby & Darby

[57] ABSTRACT

The improvement described in this invention consists of a cross-beam fitted with a lever fixed to and rotating with, at one end, to the end of a single, plate pivot pin projecting from a support frame, the other end of the lever is connected to hydraulic actuating means located on the frame and acting on the lever so as to vary the angle of the plates in relation to the conveyor belt. On the frame there is an adjustable stroke limiter which acts on the lever and limits the angular variation of the lever to within a preset range. The frame is also fitted with automatic engaging and locking means connected to the hydraulic actuating means.

6 Claims, 3 Drawing Sheets

WIDE-BELT SANDER MACHINE

BACKGROUND OF THE INVENTION

This invention concerns an improvement to wide-belt sander machines.

There are many known examples of machines of this type which are used for finishing previously produced panels.

Currently the most commonly used structure for this type of machine consists of a supporting structure holding a conveyor belt for transporting workpieces in a longitudinal direction; a sanding device consisting of a series of rollers (usually a minimum of three and a maximum of five) with parallel axes, positioned cross-ways to and above the conveyor belt. These rollers carry a closed-loop sanding belt which is tensioned by the rollers in conjunction with hydraulic cylinders; the sanding belt is fitted with a device which presses it downwards in the direction of the conveyor belt. This device is positioned parallel to the rollers on the active section between the rollers and parallel to the longitudinal feed surface of the conveyor belt. This device consists of a cross-beam supporting a series of mobile plates, each of which is independent from the others, on an axis perpendicular to the conveyor belt. The said plates can oscillate where they make contact with the sanding belt thus making it possible to vary their angle with respect to the plane defined by the conveyor belt; the angle of the plates in relation to the workpiece entering the machine can thus be varied in order to enable different types of wood sanding: for example, by slightly accentuating the angle of the plates in relation to the conveyor belt it is possible to obtain harder sanding on the infeed side and gentler sanding on the outfeed side depending on the type of wood (wood with varying degrees of homogeneity), the type of sanding required, etc.

The machine described so far appears to be very reliable but during us constructional drawbacks have been noted: adjustment operations such as changing the angle of the plates are not easy for the user to carry out while other operations, such as changing the sanding belt require the operator to carry out complex manual operations. The positioning of the presser plates at a particular angle as specified by the user is in fact executed by the machine manufacturer before the machine is delivered; if the user subsequently wishes to alter the plate angle even slightly (for machining purposes) he must stop the machine for a certain period in order to allow the operator to position the plates at the new angle, something which was directly allowed for in the design stage; this operation is slow and difficult because it requires the dismantling of part of the cross-beam supporting the plates.

Changing the sanding belt, on the other hand, involves discharging the hydraulic pistons, in order to slacken the sanding belt, and the subsequent removal of the rollers from the machine support structure so that the operator can remove the worn sanding belt and fit a new one. Generally speaking the rollers are held to the machine frame by ring nuts running on threaded pins which in turn fit into seatings on the frame and into the roller axes; by unscrewing the ring nut the operator can remove the roller from the machine. Once again the operation with this type of device is slow and complicated; during transport from the manufacturer to the user the pins and ring nuts are removed from the machine and can easily be lost as a result.

SUMMARY OF THE INVENTION

The aim of this invention is therefore to eliminate the above shortcomings through the manufacture of a belt sander machine which has automatic mechanisms to enable rapid and easy adjustment before and after the various work phases.

The invention, described in the claims below, solves the shortcomings mentioned above by using a belt sander machine equipped with a cross-beam which at one of its end is fitted with a lever fixed to and rotating with, at one end, to the end of a single plate pivot pin projecting from a support frame, the other end of the lever is connected to pneumatic actuating means located on the frame and acting on the lever so as to vary, either positively or negatively, the angle of the plates in relation to the conveyor belt. On the frame there is an adjustable stroke limiter which acts on the lever and limits the angular variation of the lever to within a preset range. The frame is also fitted with automatic engaging and locking means connected to the means for tensioning the said sanding belt which act on and are fixed to the frame and which move from a position where the frame engages on the framework so that the rollers are tensioning the sanding belt and a position where the frame is disengaged from the framework so that the rollers leave the sanding belt slack.

One of the advantages obtained using the present invention is that varying the plate angle and releasing the rollers from the main framework are performed by an external automatic control which enables the rapid disengagement and engagement of the rollers (and therefore rapid changing of the sanding belt) and also the accurate positioning of the plates on the sanding belt in accordance with the sanding requirements to be carried out.

BRIEF DESCRIPTION OF THE DRAWINGS

The invention is described in greater detail below with the aid of drawings which show one possible form of the invention and are not intended as restrictive in any way; the drawings are as follows.

DESCRIPTION OF THE PREFERRED EMBODIMENTS

Figure 1:
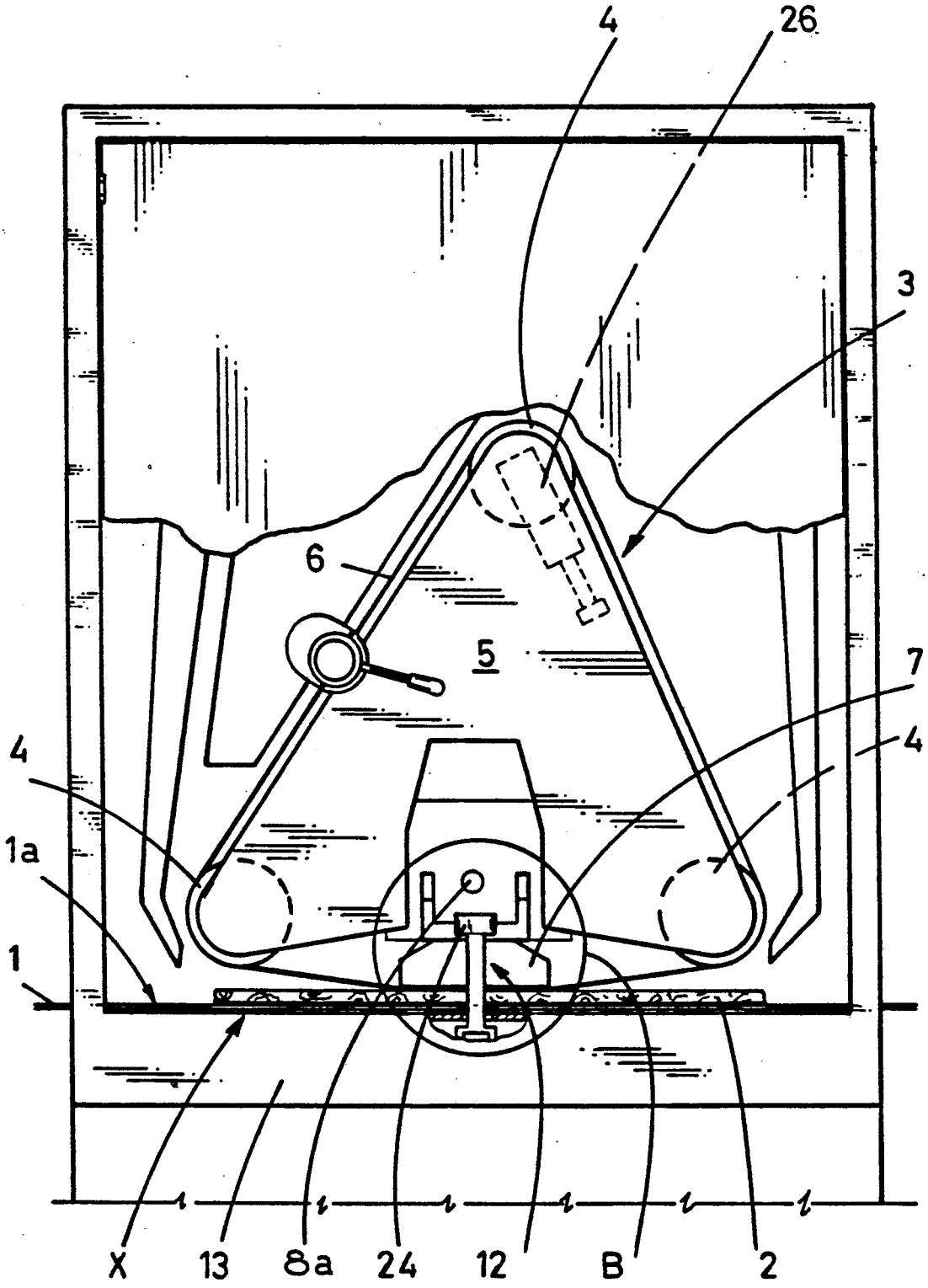
FIG. 1 shows a front view of the belt sander machine described in this invention with some parts removed for reasons of clarity.

In accordance with the drawings enclosed, the belt sander machines described here are of the type with a conveyor belt 1 for wooden workpieces 2; the conveyor belt 1 is a closed, continuous loop supported by a framework 13 and runs along a horizontal plane marked by x.

Above the active surface 1*a* of the conveyor belt there is a sander unit 3 for sanding wooden workpieces 2 consisting of a series of rollers 4 (in the case shown in FIG. 1 there are three rollers, the number could however be greater depending on the type of machine or sanding belt used) on parallel axes and, as already mentioned, positioned crossways to and above the conveyor belt 1. The pair of rollers 4 closest to the conveyor belt 1 are connected by their respective ends to a supporting frame 5 and in conjunction with the remaining roller 4 tension a closed-loop sanding belt 6 running on the rollers themselves. To tension this sanding belt 6 there is hydraulically actuated tensioning means 26 which acts (in the case illustrated) on the remaining roller 4; this means 26 consists of a hydraulic cylinder-piston assembly (shown by a broken line in FIG. 1) fixed to the frame 5 and supporting the roller 4. This cylinder-piston assembly 26 is controlled externally from the machine and has two operating positions: its raised position where the sanding belt 6 is tensioned and its lowered positioned where as a consequence the sanding belt is left slack.

In addition, the frame 5 has engaging and disengaging means, indicated as a unit with the number 12 and described in more detail below, located and acting on the frame 5. This means 12 can be moved from a position where the frame 5 engages on the framework 13 so that the sanding belt 6 is held longitudinally by the rollers 4, to a position where the frame 5 disengages from the framework 13 so that the sanding belt 6 can be horizontally removed from the rollers 4 and substituted with a new belt (obviously the piston assembly 26 is lowered at this time).

The sanding belt 6 is in contact with a series of plates 7 which pivot on a single pin 8*a* forming part of a cross-beam 8. The beam 8 is centrally positioned between the pair of lower rollers and runs parallel to these; these plates 7 have the task (as can clearly be seen in FIG. 1) of pressing the sanding belt 6, at a variable angle $\alpha$ with respect to the conveyor belt 1, downwards in the direction of the conveyor belt.

Figure 2:
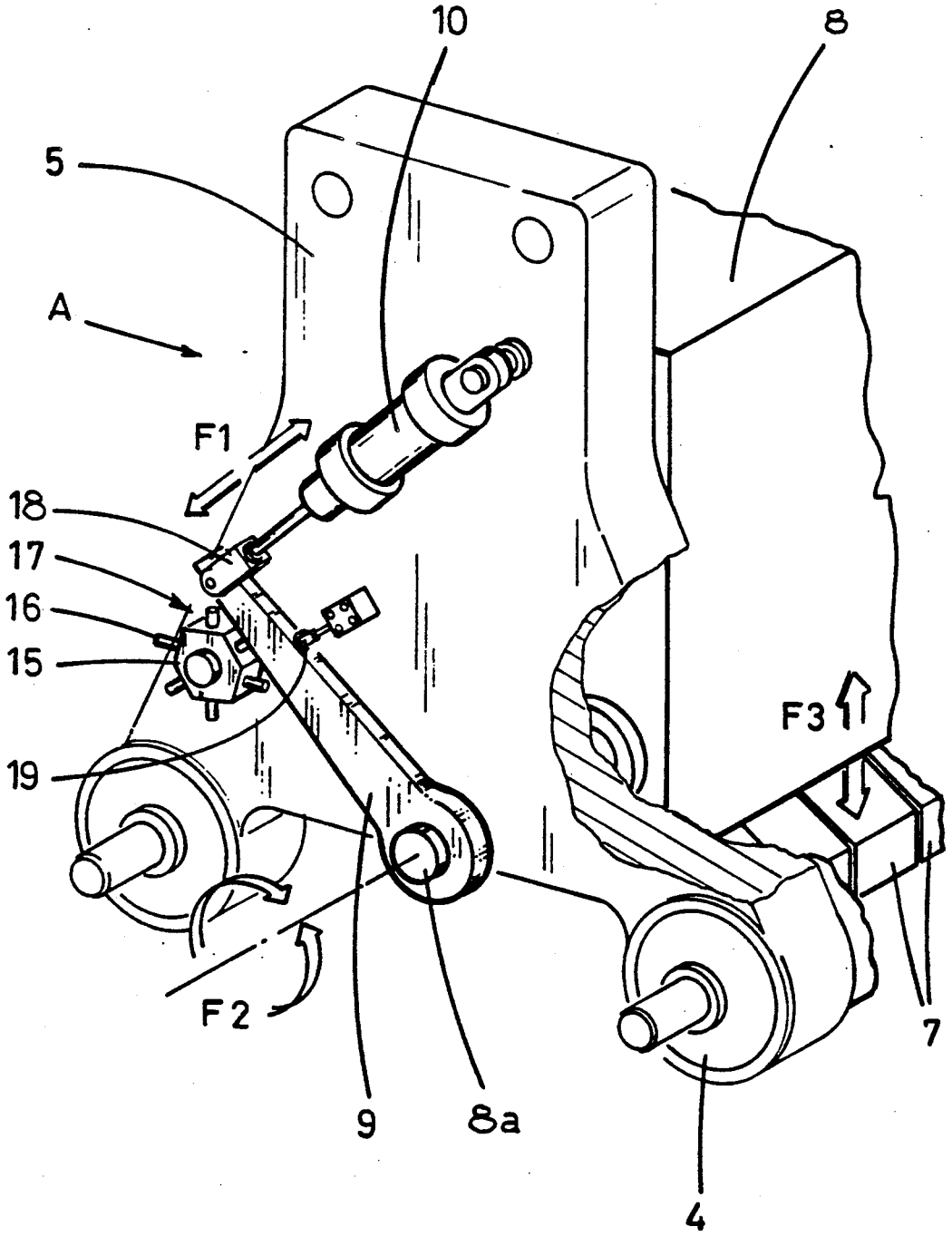
FIG. 2 shows a perspective view of the sander unit of the machine in FIG. 1 from the rear with some parts removed for reasons of clarity.

The improvement in this invention consists of fitting one end of the aforementioned cross-beam 8 with a lever 9 fixed to and rotating with, at one end, the end of a single pivot pin 8*a* for the plates 7 (see FIG. 2) which, in turn, in the case illustrated here projects from the support frame 5. The opposite end of this lever 9 is connected to hydraulic actuating means 10 located on the frame 5 and actuated by external control means which are not illustrated here because they are of a known type (such as, for example, control units operating such means through solenoid valves).

The lever 9, together with the actuating means 10, is positioned centrally on the frame 5 and is at the rear of the belt sander machine (it is virtually at the same height as the means 12 which is on the opposite side to lever 9, i.e. on the front of the machine, as can clearly be seen in FIG. 1); the means 10 consist, in the case illustrated, of a hydraulic cylinder connected at one end to the frame 5 and at the other to the lever 9 by means of a forked fitting 18; this piston 10 acts on the lever 9 in alternate directions, shown by the arrows F1, so as to rotate the said lever in the manner shown by the arrows F2; this rotation either increases or decreases the angle of the plates 7 (as shown by the arrows F3) in relation to the conveyor belt 1.

In order to limit the angle of the plates 7 with precision, there is also an adjustable stroke limiter fitted to the frame 5 (see FIG. 2) which acts on the lever 9. This stroke limiter 17 consists of a revolver turret 15 fitted to frame 5 and rotating on its own axis; it is positioned on the opposite side to the cylinder 10. This turret 15 is shaped like a nut with a series of faces and each face has a pin which is different in length from the other pins; the pins make contact with the lever 9 thus varying (increasing or decreasing depending on the length of the pin 16 selected) the aforementioned angle by discrete steps. The frame 5 is also fitted with a second fixed pin 19 on the opposite side to the turret 15, which stops the lever 9 when the latter reaches an angle which corresponds to a certain position of the plates 7 in relation to the conveyor belt 1 (for example when the plates are coplanar with the conveyor belt).

Figure 3:
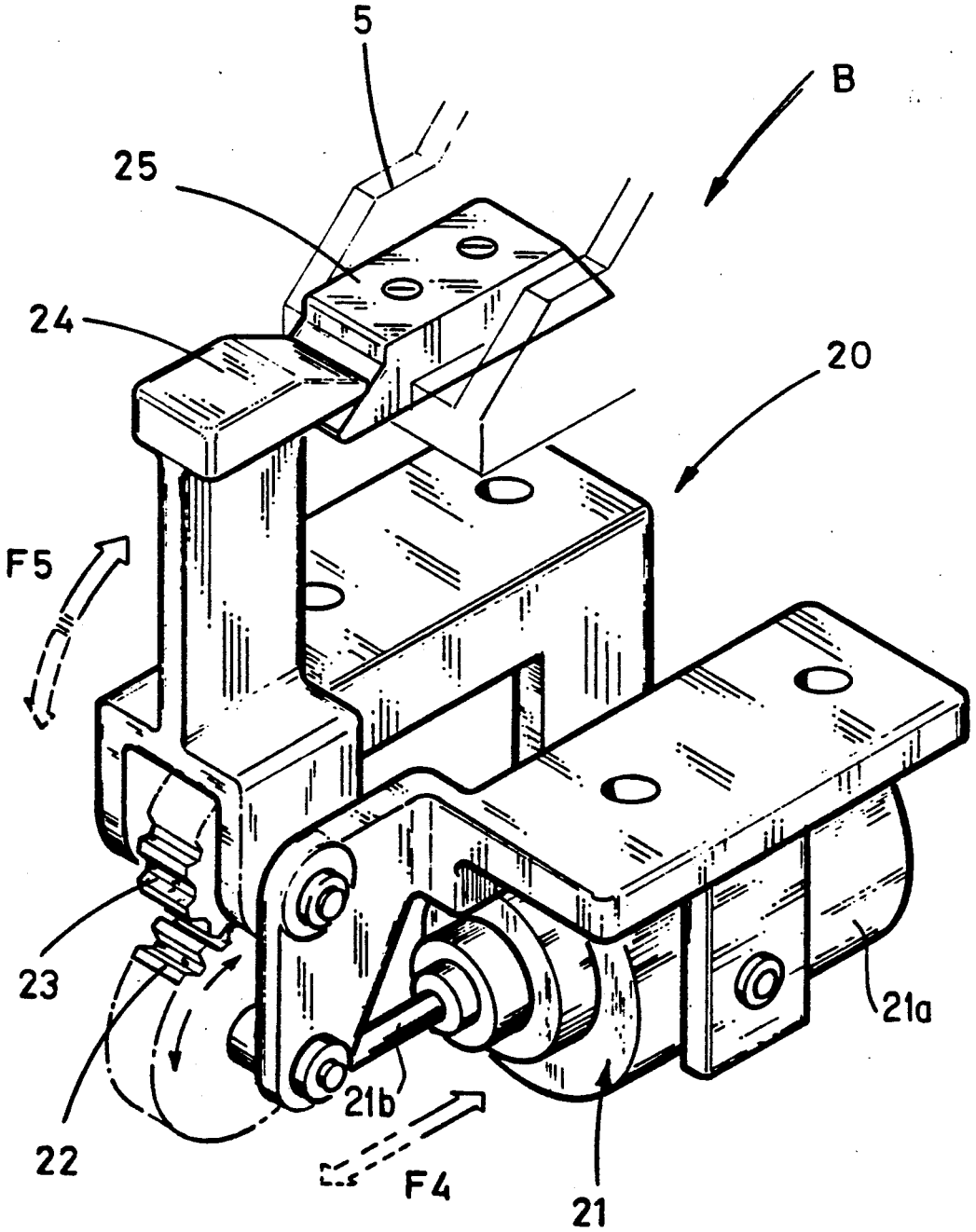
FIG. 3 shows a perspective view of engaging and disengaging means of the machine in FIG. 1 with some parts removed for reasons of clarity.

As can be seen in FIG. 3, the above-mentioned engagement and disengagement means 12 are of the automatic type and are connected to the operation of the aforementioned hydraulic actuating means 26 and are positioned and fixed to the framework 13 at an intermediate position between the two rollers 4 immediately facing the conveyor belt 1. The said means 12 consist of a framework 20 (see FIG. 3) fitted with a first rotating toothed wheel 22 which engages with a second toothed wheel 23 also fixed to the structure 20; the second toothed wheel 23 is fixed to and rotates coaxially with the end of a hook 24 which in turn pivots on the framework 20. For the rotation of the hook 24 there are hydraulic actuating means 21, supported by the framework 20, consisting of a hydraulic cylinder-piston assembly 21*a* connected to the above mentioned control means. The shaft 21*b* of the cylinder-piston assembly 21*a* acts on the first toothed wheel 22 along a horizontal path in alternate directions (shown by the arrows F4) so as to cause the counter rotation of the two toothed wheels 22 and 23 and the consequent rotation (see the arrows F5) of the hook 24 between two extreme positions: one position where the frame 5 engages with the framework 13 and the hook 24 is over a lock tooth 25 on the framework 15, and another position where the frame 5 is disengaged from the framework 13 when the hook 24 is rotated so that it is practically at right angles to and distanced from the lock tooth 25.

This type of engagement (automatic and not manual) also provides for the simultaneous positioning of the lower rollers 4 because when the hook 24 is over the lock tooth 25 the rollers are in a position where they tension the sanding belt 6 while the disengagement of the hook 24 from the lock tooth 25 positions the rollers 4 (in the case illustrated the rollers are raised from the conveyor belt 1) so that the sanding belt is slackened ready for substitution. It is obvious that at the same time as the hook 24 disengages and engages the lock tool 25 on the frame 5 carrying the rollers 4 there will be a corresponding action of the piston 26 on roller 4 because, as has already been mentioned, both pistons being of the hydraulic type can be linked to a single control unit generally used for actuating this type of device.

With a belt sander machine of the type just described it is possible therefore to speed up and automate some operations that with other more traditional machines are either not performed at all (for example, the angular adjustment of the plates) or are performed manually with added risk that parts might be lost (for example, the engagement and positioning of the lower rollers on the framework).

This invention can be subjected to numerous modifications and variations, all of which are within the terms of this invention. Any or all of these details can be replaced by their technical equivalents.

What is claimed is:

1. A wide-belt sander machine for sanding wooden panels, comprising:

horizontal conveyor means for supporting the panels and including a conveyor belt and a framework for supporting the conveyor belt;

sander means including a frame located above the conveyor means, a plurality of rollers supported on the frame and having their axes extending parallel to each other, and a sanding belt supported on the rollers;

means for pressing the sanding belt downwards at a variable angle and including a plurality of plates movable perpendicularly to the conveyor means and engaging the sanding belt, a pivotable pin for supporting the plates for movement perpendicularly to the conveyor means, a cross-beam positioned between the rollers for supporting the pivotable pin, means for pivoting the pivotable pin and comprising actuating means mounted on the frame, a pivotable lever connected to one end thereof with the pivotable pin for joint pivotal movement therewith and at the other end thereof to the actuating means, and adjustable stop means mounted on the vertical frame for limiting angular movement of the pivotable lever to thereby maintain angular positions of the plates within a predetermined range; and engaging and disengaging means mounted on the framework of the conveyor means and engageable with the frame of the sandar means to hold the sander means in an operational position thereof and disengageable from the frame to provide for non-operational position of the sander means in which the sanding belt may be changed.

2. A belt sander machine as set forth in claim 1, further comprising hydraulic means associated with one of the sanding belt supporting rollers for tensioning the sanding belt.

3. A belt sander machine as set forth in claim 2 wherein the engaging and disengaging means includes drive means actuatable synchronously with respective actuation of the hydraulic tensioning means.

4. A belt sander machine as set forth in claim 1 wherein the adjustable stop means comprises a revolver turret supported on the frame for rotation about its axis, arranged on one side of the pivotable lever and having on faces thereof pins of variable length for respectively limiting the pivotal movement of the pivotable lever in one direction, and a stop pin arranged on the other side of the pivotable lever for limiting the pivotal movement of the pivotable lever in a direction opposite to the one direction.

5. A belt sander machine as set forth in claim 1 wherein the frame has a lock tooth, the engaging and disengaging means comprising a hook member for engaging the lock tooth, a first gear fixedly connected with the hook member for rotating the same between a first position in which the hook member engages the lock tooth to hold the sander means in the operational position thereof, and a second position in which the hook member is disengaged from the lock tooth so that the sander means is in the non-operational belt changing position thereof, a second gear for rotating the first gear, and a hydraulic actuator for rotating the second gear.

6. A belt sander machine as set forth in claim 5 wherein the engaging and disengaging means further comprises a frame supported on the framework of the conveying means and on which the hook member and the first and second gear are supported, the hydraulic actuator being also supported on the frame and including a shaft connected at one end thereof to the second gear for rotating the same.

* * * * *